US006986496B2

(12) United States Patent
Woude

(10) Patent No.: US 6,986,496 B2
(45) Date of Patent: Jan. 17, 2006

(54) PORTABLE POST SUPPORT

(76) Inventor: Keith Vander Woude, 2337 Ridge Rd., Lansing, IL (US) 60438; by Evan D. Roberts, legal representative, P.O. Box 369, Peotone, IL (US) 60468-0369

( * ) Notice: Subject to any disclaimer, the term of this patent is extended or adjusted under 35 U.S.C. 154(b) by 237 days.

(21) Appl. No.: 10/630,827

(22) Filed: Jul. 31, 2003

(65) Prior Publication Data

US 2005/0023428 A1 Feb. 3, 2005

(51) Int. Cl.
*F16M 13/00* (2006.01)

(52) U.S. Cl. ..... 248/519; 40/607.01

(58) Field of Classification Search ..... 248/519, 248/521, 523; 40/607.01, 607.06, 607.1, 40/607.11, 607.12; 116/63 C, 63 P
See application file for complete search history.

(56) References Cited

U.S. PATENT DOCUMENTS

| | | | | | |
|---|---|---|---|---|---|
| 1,687,790 | A | * | 10/1928 | Powers | 40/607.11 |
| 1,725,244 | A | * | 8/1929 | Keats | 40/607.1 |
| 3,119,588 | A | * | 1/1964 | Keats | 248/158 |
| 3,833,168 | A | | 9/1974 | Sackrison | |
| 4,050,401 | A | | 9/1977 | Kelly | |
| 4,588,123 | A | | 5/1986 | Plew | |
| 4,591,126 | A | * | 5/1986 | Berney | 248/524 |
| 4,611,949 | A | | 9/1986 | Schmanski | |
| 5,031,828 | A | | 7/1991 | Fischer | |
| 5,066,163 | A | | 11/1991 | Whitaker | |
| 5,071,063 | A | | 12/1991 | Overstreet | |
| 5,215,400 | A | | 6/1993 | Hugron | |
| 5,220,740 | A | | 6/1993 | Brault | |
| 5,244,172 | A | | 9/1993 | Allega | |
| 5,271,594 | A | * | 12/1993 | Djelouah | 248/523 |
| 5,354,031 | A | | 10/1994 | Bilotti | |
| 5,678,757 | A | | 10/1997 | Martin | |
| 6,070,848 | A | * | 6/2000 | Ogren | 248/523 |
| 6,446,930 | B1 | * | 9/2002 | Li | 248/519 |
| 6,557,297 | B2 | * | 5/2003 | Receveur | 47/39 |
| 2004/0056169 | A1 | * | 3/2004 | Harbaugh | 248/519 |
| 2004/0069922 | A1 | * | 4/2004 | Wu | 248/519 |

* cited by examiner

*Primary Examiner*—Ramon O. Ramirez
*Assistant Examiner*—Amy J. Sterling
(74) *Attorney, Agent, or Firm*—Evan D. Roberts

(57) ABSTRACT

A portable post support provided with a body to be supported on a horizontal surface, an upwardly opening body chamber and a top portion having a central vertical support opening there through, and one or more separate openings spaced from the central opening for receiving flowable ballast material into body chamber, body top securable to said body and means for securing a post to the body bottom.

2 Claims, 2 Drawing Sheets

PORTABLE POST SUPPORT

BACKGROUND OF THE INVENTION

Existing known types of portable post supports often provide a solid post support with the post embedded therein, or even other than a solid base, do not provide for a portable support available for a vertical post to be supported therein or through.

Also, none of the known types of portable post supports provide for portable support, as well as facilitating the embedding of the post in the ground or other horizontal support surface, as well as the base thereof, for additional portability of support.

SUMMARY OF THE INVENTION

This invention relates to a post support which is completely portable and provides support for a post which is either in the ground or totally above ground and yet is substantially as strong in its support as the generally known types of non-portable post supports.

Another object of this invention is to provide a portable post support wherein the portability of the support is partially obtained by a body chamber adapted to receive flowable ballast material, wherein the ballast material can be added or withdrawn pursuant to the portability of the structure of this invention.

A further object of this invention is to provide a portable post support with portability of the support by a body which is provided with post support in the top and bottom of the body thereof to allow the post to be readily inserted or withdrawn through the support body, augmenting the portability of the post support, as well as the strength of the support of a post.

Also, an object of this invention is to provide a portable post support that will resistibly yield to nominal horizontal impact forces such as might be imposed by vehicles in a parking lot.

Further, an object of this invention is to provide a portable post support having a normally vertically open chamber and a lid or cover securable thereto to the body of the post support.

Other advantages and other novel aspects of the invention will become apparent upon consideration of the following detailed description thereof in conjunction with the accompanying drawings wherein.

Figure 1:
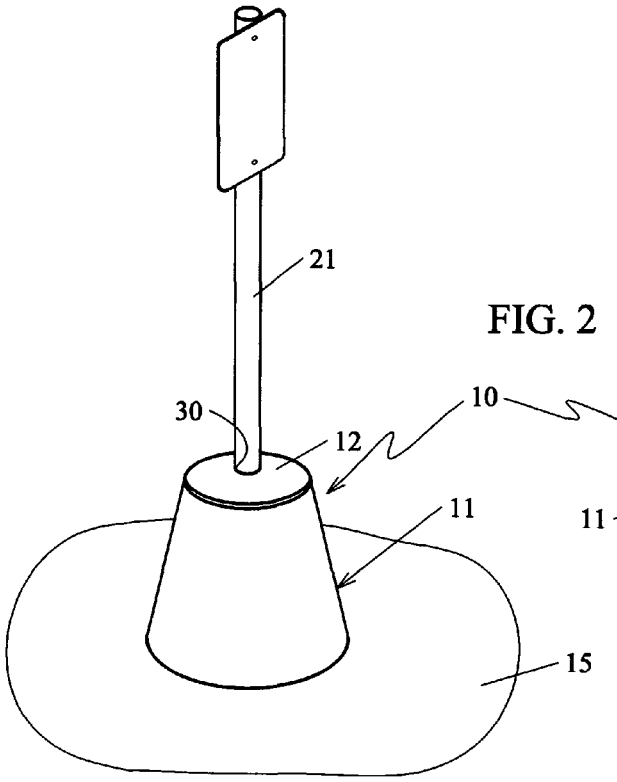
FIG. 1 is a general perspective illustration of the portable post support of this invention as it might be applied to a parking lot or other horizontal surface.
Figure 2:
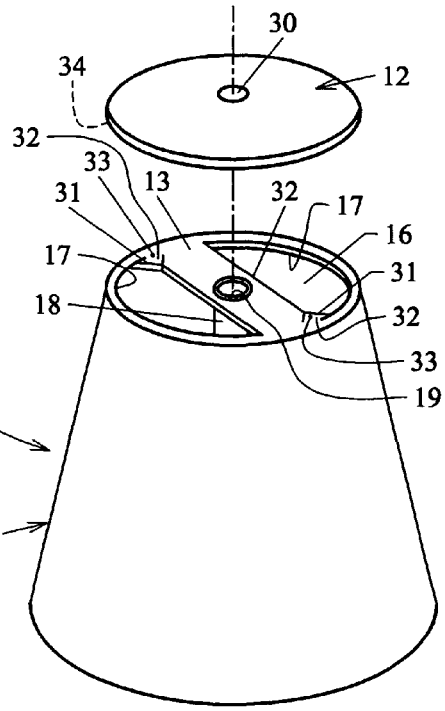
FIG. 2 is an exploded view of the supporting body, and cover therefor, showing the upper openings of the cavity of the support body and the bridging body top portion extending across the cavity of the body.
Figure 4:
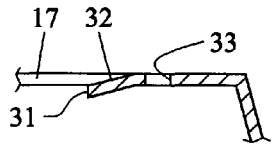
FIG. 4 is a partial sectional view taken along line 3—3 of FIG. 3 showing a cam edge with an inclined surface and a protrusion receiving aperture at the top of the body of the support.
Figure 3:
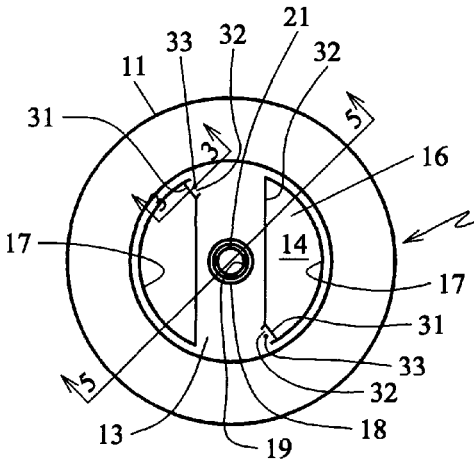
FIG. 3 is a top view of the support body of the invention showing the most effective location of the body top portion and vertical post support opening and a separate top opening.

A portable post support of this invention is generally illustrated by the numeral 10 (FIGS. 1, 2, 3, 4, 9 and 10), and includes generally a somewhat flexible body 11 and a body top cover 12 (FIGS. 1, 2, 6–10).

Body 11 has bottom 14 for supporting body 11 on a generally horizontal surface 15 (FIGS. 1, 5, 9 and 10), and is provided with a cavity chamber 16, formed by tapered sides 19, and that opens upwardly through openings 17 of body top portion 13. Body top portion 13 (FIGS. 2, 3, 5, 9 and 10) on body 11 extends, as a support bridge, across cavity chamber 16. A post support conduit 18 can be secured to top portion 13 and bottom 14 through body 11 to support post 21 through passage opening 19 thereof, and has a support passage opening 19 for receiving and laterally supporting post 21 there through.

Body openings 17 provide (FIGS. 2–5, 9 and 10) through which flowable ballast material 22 (FIGS. 9 and 10), such as sand, gravel or water, can be poured into cavity 16 of body 11. It should be noted that cavity 16 should not be entirely filled with flowable ballast material 22. An airspace 23 (FIGS. 9 and 10) will accommodate some shifting of the flowable material 22 caused by weather heating or cooling in chamber 16 or in the event a force 24, such as by a vehicle in a parking lot (FIG. 7) is applied or imposed against body 11, deforming side 19 and cavity 16 of body 11.

Portable post support 10 can be provided with opening 25 (FIG. 9) in bottom 14 for laterally securing post 21 in the bottom 14 of body 11. In this embodiment, post 21 extends through posts support 10 and into support surface 15. In the alternative (FIG. 10), post 21 is laterally secured to body bottom 14 by an embossment 26 extending upwardly into chamber 16 and into post support conduit. Body top cover 12 is provided with central post opening 30 (FIGS. 1, 2, 6–10) concentric with conduit support 18 to accommodate post 21 there through with top cover 12 positioned on top portion 13 of body 11.

Top cover 12 is securable to body top portion 13 by the combination of securing structures of body top portion 13 and top cover 12. In particular, a cam edge 31 (FIG. 4) is provided on opposite sides 32 of top portion 13 (FIGS. 2, 3 and 4) and has one or more cam surfaces 32 (FIG. 4) inclined toward body bottom 14 from body top portion into cavity chamber 16. Also, cam protrusion apertures 33 are provided adjacent respective cam surfaces 32 to receive a respective protrusion 35 extending from top cover under surface 34.

Further, in regard to structure for securing cover 12 to body 11, cover 12 is provided with restraining projections 40 (FIGS. 7 and 8) extending at an acute angle from top cover under surface 34. Restraining projections 40 have upper surface 36 adapted to engage cam edge 31 (FIGS. 3 and 4) when cover 12 is in position over body top portion 13 (FIGS. 9 and 10) and cover is rotated about post 21 or post opening 30 (FIG. 8) moving respective protrusions toward cam edge 31 and protrusions into respective apertures 33.

Figure 10:
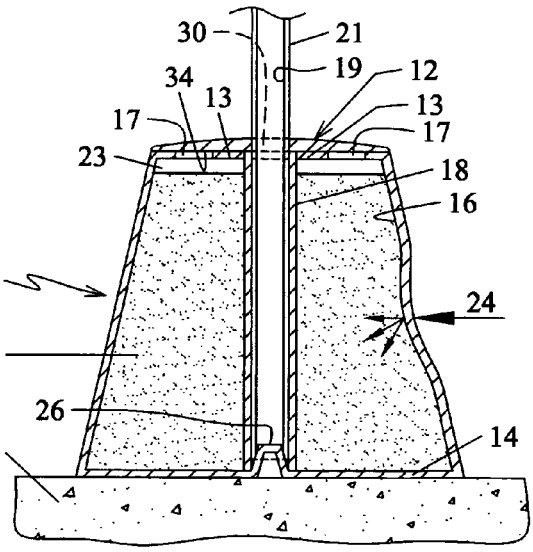
FIG. 10 is a vertical sectional view taken along line 5—5 of FIG. 3 showing the most effective configuration of the body of the invention with the upwardly opening cavity and a post vertical positioned there through and supported on a tapered embossment projection on the body bottom and schematically showing the yielding effects of a horizontal force imposed on the post support hereof.

In use and operation, the portable post support 10, of this invention, provides portable support for sign posts 21 and similar items which can be supported on, or inserted or embedded, in a horizontal surface 15 such as asphalt parking lot or the ground (FIGS. 1 and 9) or totally above ground (FIGS. 1 and 10).

In the situation where the portable post support 10, of this invention, is to be portably utilized to support a post mounted in ground 15, such as post 21 (FIG. 9), portable post support 10 is inserted through support conduit 18 and opening 25 of body 11 over the top of post 21 before any sign or other items are attached to post 21. Body 11 is moved downwardly over the post 21 to a position on horizontal surface 15 (FIG. 1) in which post 21 is embedded.

Figure 5:
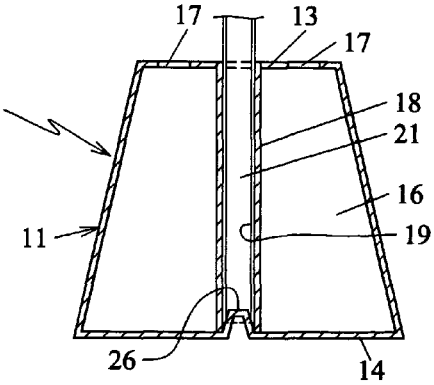
FIG. 5 is a vertical sectional view taken along line 5—5 of FIG. 3 showing the most effective configuration of the body of the invention with the upwardly opening cavity and a post vertically positioned there through and supported on a tapered embossment projection on the body bottom.
Figure 6:
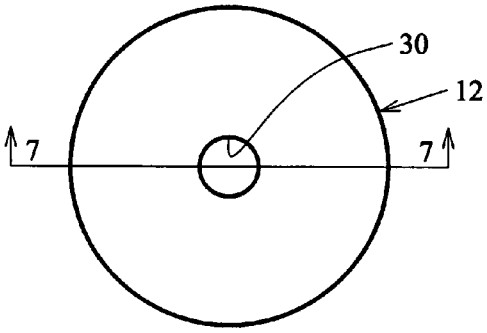
FIG. 6 is a view of the top cover for the body.
Figure 7:
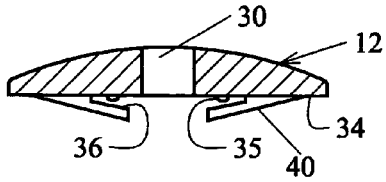
FIG. 7 is a sectional view of the top cover taken along line 7—7 of FIG. 6 showing the post opening and top cover securing and restraining projections and complimenting protrusions on the bottom of the top cover.
Figure 8:
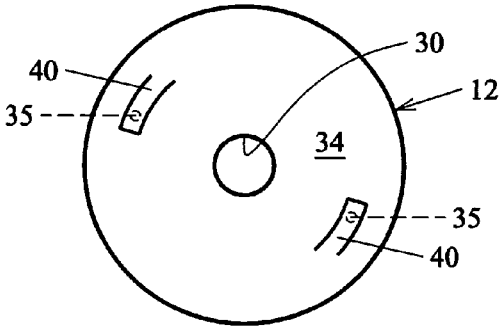
FIG. 8 is a bottom view of the top cover showing the post opening and top cover securing and restraining projections and complimenting protrusions on the bottom of the top cover.
Figure 9:
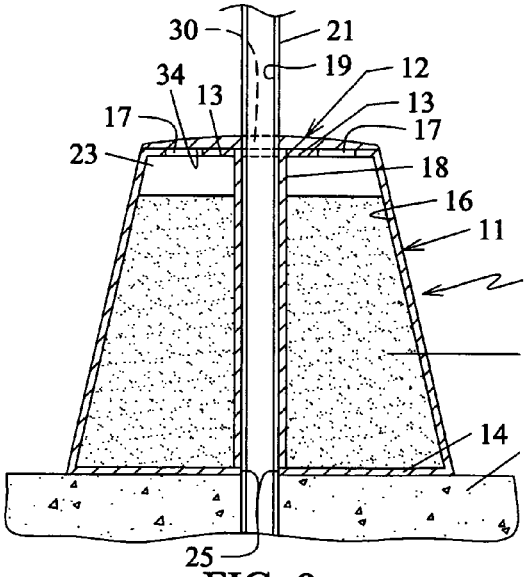
FIG. 9 is a sectional vertical view of the portable post support of this invention taken along line 5—5 of FIG. 3 showing the support body in position with a post inserted entirely there through and into the ground or other horizontal support surface.

Thereafter, ballast 22 is added to body 11 through openings 17 in body top portion 13 (FIGS. 2–5) to a level near top portion 13 (FIG. 6). Cover 12 is then inserted over post 21 by inserting post 21 through central opening 30 of cover 12. Cover 12 is moved downwardly (FIG. 6) onto body top portion 13 to cover openings 17 of body top 13. Cover 12 can thereafter be secured to top portion 13 by rotating cover about post 21 as set forth above.

Alternatively, in the situation wherein portable post support 10, of this invention, can be portably utilized to support a post, such as post 21 when post 21 is not to be inserted into ground 15 (FIGS. 5 and 10). In that alternative, post support 10 is placed on surface 15, post 21 inserted through post support conduit 18 in body top portion 13, through cavity chamber 16 of body 11 and positioned over embossment 26 on bottom 14. Post 21 is thereby laterally secured on bottom 14. In addition, post 21 can be secured to embossment 26 by screws or bolts (not shown) for additional security.

Thereafter, ballast is added to body 11 of portable post support 10 through openings 17 (FIGS. 2–4 and 5) to a level near body top 13 (FIG. 6). Cover 12 is then inserted over post 21 by inserting post 21 through opening 30 of cover 12. Cover 12 is moved downwardly on post 21 onto body top 13 to cover opening 17 of body top 13. Cover 12 is secured to top 13 by rotating cover 12 on body top portion to cause protrusions 35 of restraining projections 40 to engage cam surface 31 and ultimately protrusion 35 into respective protrusion apertures 33, as set forth above.

It is to be understood that the invention is not to be limited to the specific construction and arrangements shown and described, as it will be understood to those skilled in the art that certain changes may be made without departing from the principles of the invention.

What is claimed:

1. A portable post support comprising a body of a certain height, said body having a bottom adapted to be supported on a generally horizontal support surface and a chamber opening upwardly from said body for receiving and retaining flowable ballast material into said body chamber, said body having a body top portion extending across the opening of said chamber of said body and having a vertical central support conduit adapted for supporting a post there through toward said body bottom, a body top cover, means for securing said body top cover to said body top portion, post securing means on said body bottom within said body chamber for securing a post to said body bottom, said body top portion having a separate opening means spaced from said chamber opening thereof to allow the flowable ballast material to be passed there through into the chamber of said body, said body cover has an under surface adapted to rest on said body top portion for covering said body top portion when placed thereon, said cover having a central opening there through to receive a post there through and securing means in said body top cover and said body top portion for securing said body cover to said body top portion comprises a cam edge on said body top portion within said top opening, a cam surface inclined toward said body bottom, an aperture adapted to receive a certain protrusion, a restraining projection extending at an acute angle from said body cover under surface, and a protrusion extending from said cover under surface toward said restraining projection, said restraining projection having an upper surface facing said cover under surface and said protrusion, said protrusion being adapted to engage and detent into said cam edge opening when said body cover is placed on said body top portion and rotated about said top portion support opening to move said protrusion toward said inclined cam edge between said restraining projection and said cover protrusion forcing said cover protrusion into said incline aperture whereby said cover will be restrained on said body top portion to secure said body cover to said body top portion for retaining said cover on said body whereby when the flowable ballast material is placed in said body chamber said body will tend to support a post positioned within said body and secured to said bottom of said body.

2. The portable post support as defined in claim 1 wherein said post securing means on said body bottom comprises an opening in said body bottom adapted to receive a post there through whereby such post is secured from lateral movement with respect to said body bottom.

* * * * *